US006979237B2

(12) United States Patent
Xiang et al.

(10) Patent No.: US 6,979,237 B2
(45) Date of Patent: Dec. 27, 2005

(54) ELECTRICAL CONNECTOR HAVING RECEPTACLE CONTACTS

(75) Inventors: XinHai Xiang, Kunsan (CN); ZenCai Tao, Kunsan (CN); Zheng Li, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/428,915

(22) Filed: May 2, 2003

(65) Prior Publication Data

US 2004/0198102 A1 Oct. 7, 2004

(30) Foreign Application Priority Data

Apr. 2, 2003 (TW) ..... 92205204

(51) Int. Cl.[7] ..... H01R 13/11

(52) U.S. Cl. ..... 439/856

(58) Field of Search ..... 439/856, 857

(56) References Cited

U.S. PATENT DOCUMENTS

| | | | | | |
|---|---|---|---|---|---|
| 4,408,824 | A | * | 10/1983 | Weidler | 439/886 |
| 4,789,346 | A | | 12/1988 | Frantz | |
| 4,842,528 | A | | 6/1989 | Frantz | |
| 4,943,248 | A | * | 7/1990 | Colleran et al. | 439/857 |
| 5,062,813 | A | * | 11/1991 | Liu et al. | 439/857 |
| 5,306,182 | A | * | 4/1994 | Fukushima et al. | 439/857 |
| 5,454,727 | A | * | 10/1995 | Hsu | 439/263 |
| 6,402,571 | B1 | * | 6/2002 | Muller et al. | 439/745 |

* cited by examiner

*Primary Examiner*—Renee Luebke
(74) *Attorney, Agent, or Firm*—Wei Te Chung

(57) ABSTRACT

An electrical connector (1) includes an insulative housing (10) defining a number of passageways (14), and a number of receptacle contacts (20) received in the passageways of the insulative housing. Each receptacle contact has a body portion (22), a pair of arms (30) extending from the body portion, a pair of mating portions (32) formed on free ends of the arms, and a tail portion (24) extending from the body portion. Each mating portion has an upper and a lower enlarged portions (322,321). The upper enlarged portion is vertically aligned with the lower enlarged portion.

14 Claims, 6 Drawing Sheets

ELECTRICAL CONNECTOR HAVING RECEPTACLE CONTACTS

BACKGROUND OF THE INVENTION

1. Field of the Invention

The present invention is related to an electrical connector, and particularly to an electrical connector having receptacle contacts matable with cylindrical pins.

2. Description of Related Art

Electrical connectors having receptacle contacts matable with cylindrical pins of complementary connectors are widely used in computers and other electronic equipments. Referring to FIG. 5, one type of receptacle contact 40 of these electrical connectors is disclosed, the receptacle contact 40 comprises a cylindrical portion 42, a pair of separated mating portions 44 extending forwardly from the cylindrical portion 42, and a tail portion 41 extending rearwardly from the cylindrical portion 42. The two mating portions 44 have two opposite curved faces. Further referring to FIG. 6, when a complementary pin 50 is inserted into between the two curved faces of the two mating portions 44 of the receptacle contact 40 and is clamped therein, the curved faces of the mating portions 44 abut against an outer face of the complementary pin 50 for electrically connecting the receptacle contact 40 and the complementary pin 50.

However, since the receptacle contact 40 is stamped from a piece of metallic plate and two opposite sides of the plate need to be bent upwardly to form the cylindrical portion 42 and the mating portions 44, the width of the plate needed for producing each receptacle contact 40 and a pitch P' between two adjacent receptacle contacts 40 on a contact strip 4 are relatively large, thereby wasting the material of the contact strip 4 and increasing the cost of the receptacle contacts 40.

Hence, an improved contact is desired to overcome the disadvantage of the prior art.

SUMMARY OF THE INVENTION

A major object of the present invention is to provide an electrical connector having receptacle contacts which reduce the cost of the electrical connector.

To achieve the above object, an electrical connector in accordance with the present invention comprises an insulative housing defining a plurality of passageways, and a plurality of receptacle contacts received in the passageways of the insulative housing. Each receptacle contact comprises a body portion, a pair of arms extending from the body portion, a pair of mating portions formed on free ends of the arms, a tail portion extending from the body portion. Each mating portion of the receptacle contact has an upper and lower enlarged portions. The upper enlarged portion is vertically aligned with the lower portion.

Other objects, advantages and novel features of the invention will become more apparent from the following detailed description when taken in conjunction with the accompanying drawings.

DETAILED DESCRIPTION OF THE INVENTION

Figure 1:
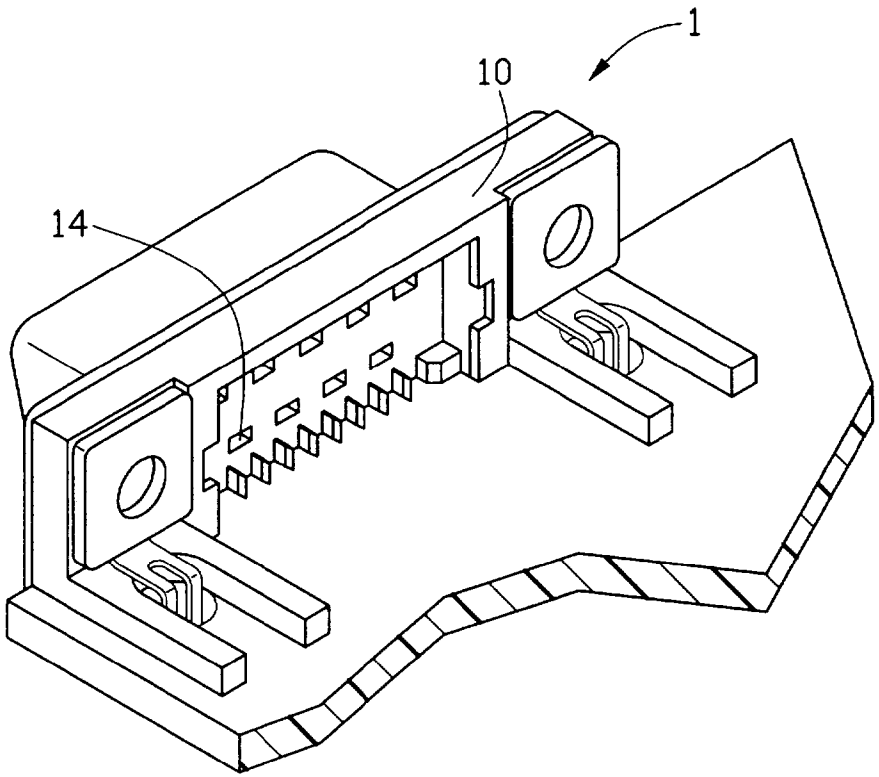
FIG. 1 is a perspective view of an electrical connector in accordance with the present invention mounted to a printed circuit board, but contacts thereof have been taken away.
Figure 2:
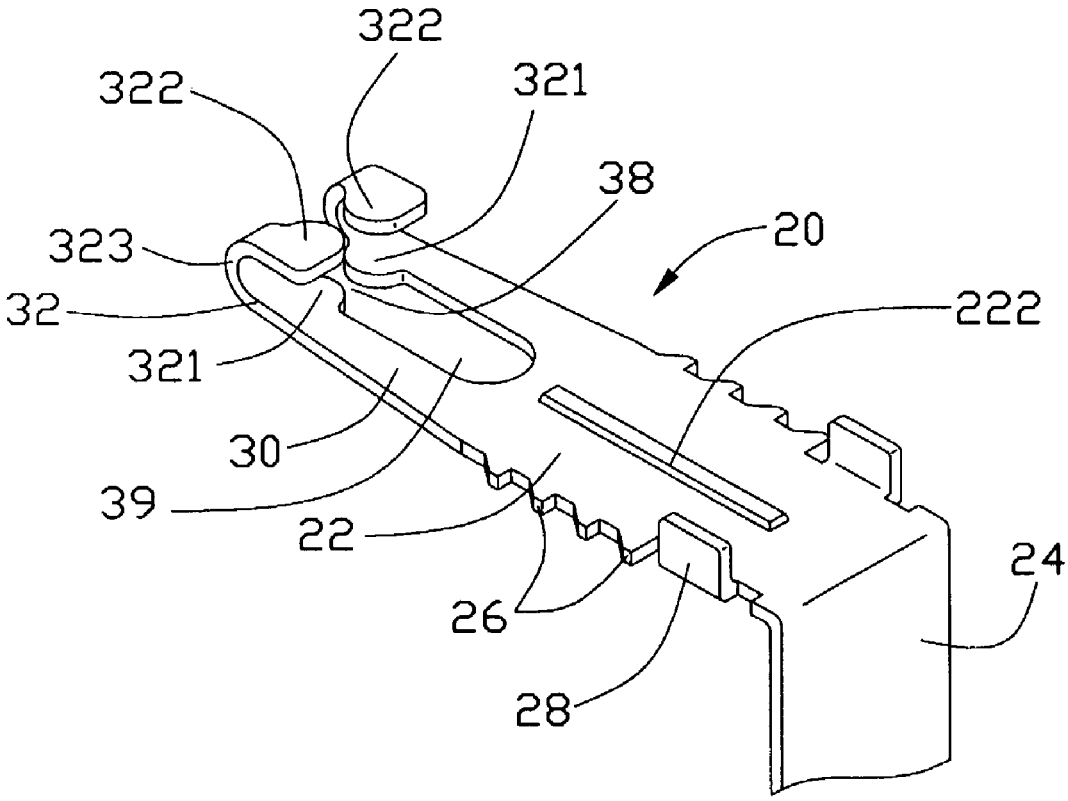
FIG. 2 is a partially enlarged perspective view of a receptacle contact of the electrical connector of FIG. 1.

Referring to FIGS. 1 and 2, an electrical connector 1 in accordance with the present invention comprises an insulative housing 10 defining a plurality of passageways 14 and a plurality of receptacle contacts 20 received in the passageways 14 of the insulative housing 10.

Each receptacle contact 20 comprises a substantially planar body portion 22, a pair of separated arms 30 extending forwardly from the body portion 22 in a longitudinal direction of the body portion 22, a pair of mating portions 32 formed on free ends of the two arms 30, and a tail portion 24 extending from the body portion 22.

A plurality of barbs 26 are formed on two opposite sides of the body portion 22. A pair of tabs 28 extend upwardly from the opposite sides of the body portion 22 respectively and are located rearwardly of the barbs 26. When the receptacle contacts 20 are received in the passageways 14 of the insulative housing 10, the barbs 26 and the tabs 28 engage with the insulative housing 10 for securing the contacts 20 in the passageways 14 of the insulative housing 10. A rib 222 is formed along the longitudinal direction of the body portion 22 to improve the mechanical strength of the body portion 22. Each mating portion 32 comprises a lower enlarged portion 321, a curved portion 323 bending from the lower enlarged portion 321 in a direction which is substantially perpendicular to the longitudinal direction of the body portion 22, and an upper enlarged portion 322 extending rearwardly from the curved portion 323.

The lower and the upper enlarged portions 321, 322 of one mating portion 32 are opposite to the lower and the upper enlarged portions 321, 322 of the other mating portion 32 respectively, with the pair of regular-sized curved portions 323 intermediating therebetween. Widths of the upper enlarged portions 322 are substantially equal to widths of the lower enlarged portions 321 and are larger than widths of remaining portions of the arms 30, so a space 38 between the two lower enlarged portions 321 or between the two upper enlarged portions 322 is smaller than a space 39 between the two arms 30. The upper enlarged portion 322 of each mating portion 32 is vertically aligned with the lower enlarged portion 321 of the same mating portion 32. The body portion 22, the two arms 30 and the two lower enlarged portions 321 of the two mating portion 32 are located in a first plane. The two upper enlarged portions 322 of the two mating portions 32 are located in a second plane which is substantially parallel to the first plane.

Figure 3:
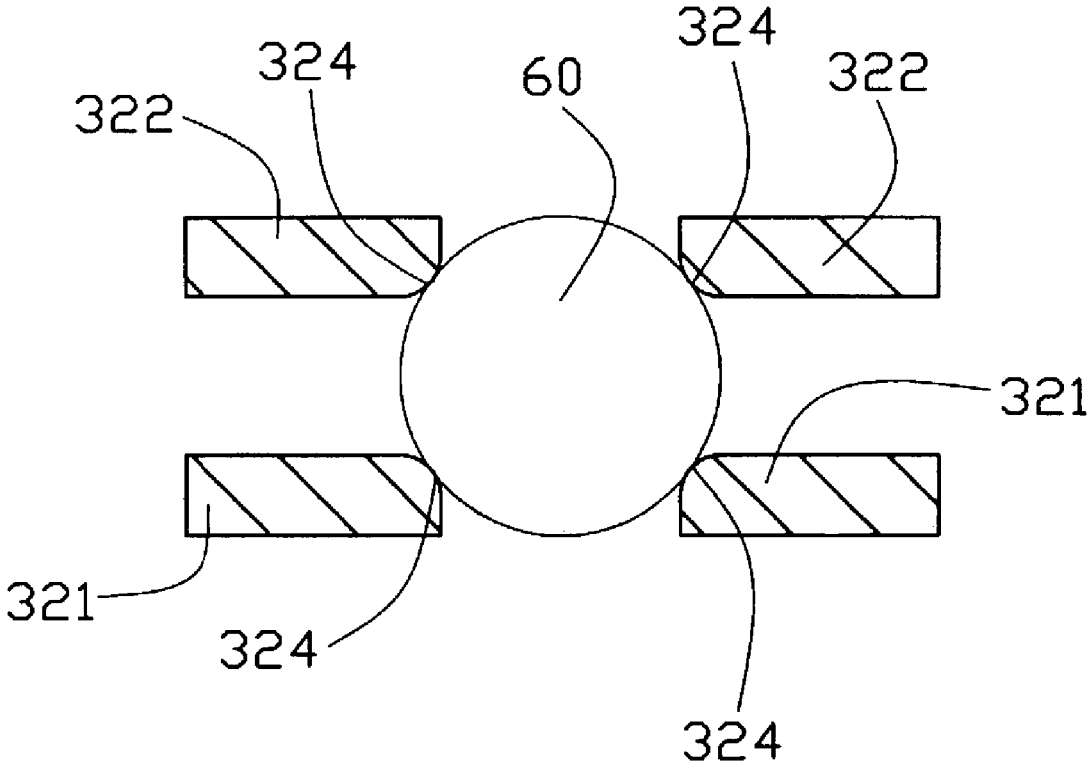
FIG. 3 is an enlarged cross-sectional view of the receptacle contact of FIG. 2 mating with a complementary pin.

Referring to FIG. 3, each enlarged portion has a chamfered face 324. When a cylindrical complementary pin 60 is inserted into between the mating portions 32 of the receptacle contact 20, the chamfered faces 324 of the lower and the upper enlarged portions 321, 322 of the two mating portions 32 abut against an outer face of the cylindrical complementary pin 60 to electrically connect the receptacle contact 20 and the complementary pin 60.

Figure 4:
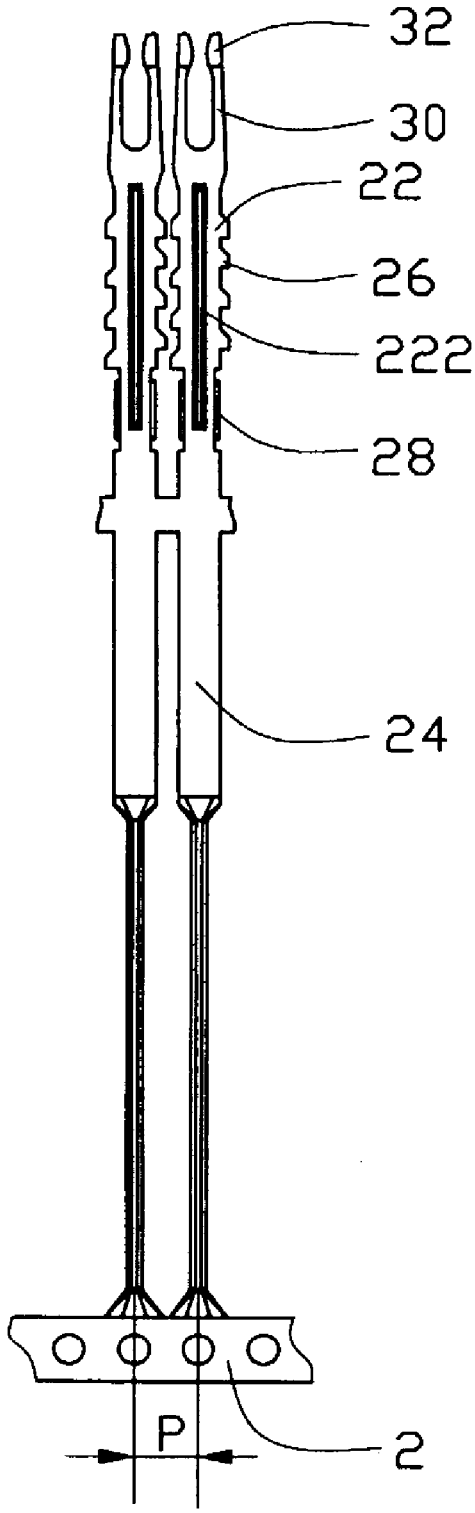
FIG. 4 is a top view of two adjacent receptacle contacts on a contact strip.
Figure 5:
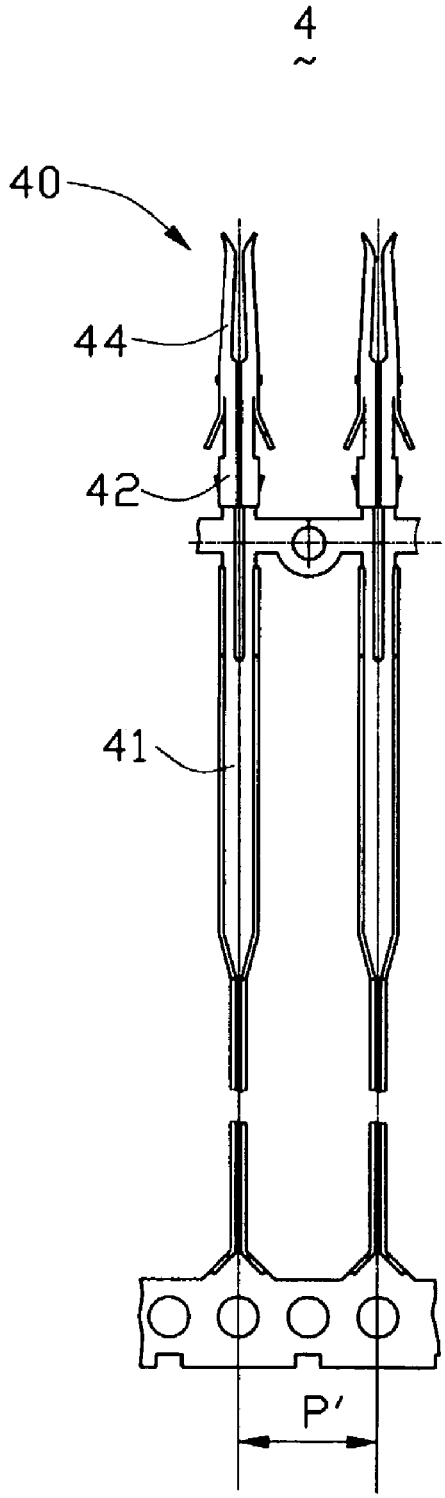
FIG. 5 (PRIOR ART)
FIG. 5 is a top view of two conventional adjacent receptacle contacts on a contact strip.
Figure 6:
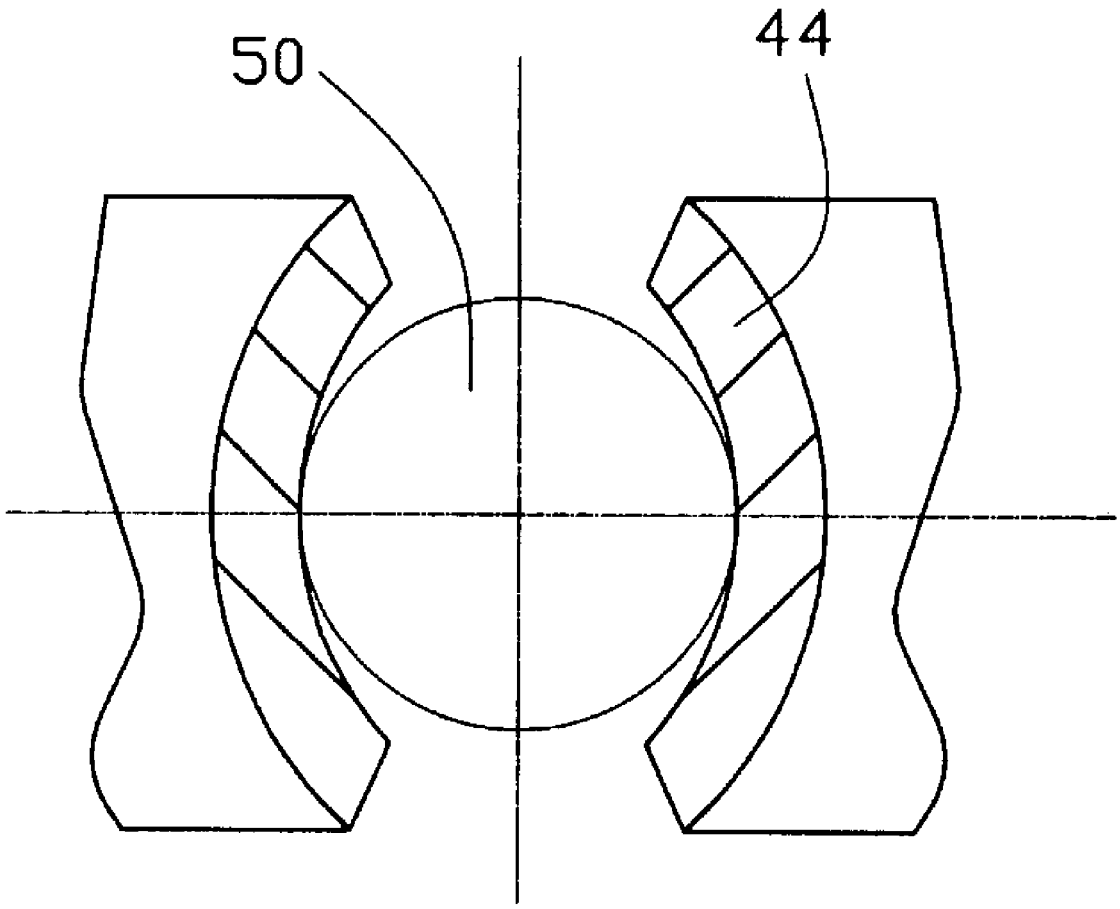
FIG. 6 (PRIOR ART)
FIG. 6 is an enlarged cross-sectional view of one receptacle contact of FIG. 5 mating with a complementary pin.

Referring to FIG. 4, since the two mating portions 32 of one receptacle contacts 20 are formed on the free ends of the arms 30 and extend along the longitudinal direction of the body portion 22, a pitch P between two adjacent recepticle contacts 20 on a contact strip 2 is far smaller than the pitch P' between the two conventional adjacent receptacle contacts 40 on the contact strip 4, thereby economizing the contact strip 2 and reducing the cost of the receptacle contacts 20. It is to be understood, the two upper enlarged portions 322 of the two mating portions 32 can be located under and be vertically aligned with the two lower enlarged portions 321 respectively.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector mating with a complementary connector, the complementary connector having a plurality of cylindrical pins, the electrical connector comprising:

an insulative housing defining a plurality of passageways; and a plurality of receptacle contacts received in the passageways of the insulative housing electrically connecting with the cylindrical pins of the complementary connector, each receptacle contact comprising a body portion, a pair of arms extending from the body portion, and a pair of mating portions formed on free ends of the arms, each mating portion comprising an upper and a lower enlarged portion securely gripping the cylindrical pin, the upper enlarged portion being vertically aligned with the lower enlarged portion and being movable in an upper-to-down direction relative to the lower enlarged portion.

2. The electrical connector as claimed in claim 1, wherein the body portion comprises a plurality of barbs formed on two opposite sides thereof.

3. The electrical connector as claimed in claim 1, wherein the body portion comprises a pair of tabs extending upwardly from two opposite sides thereof.

4. The electrical connector as claimed in claim 1, wherein the body portion comprises a rib formed along a longitudinal direction thereof.

5. The electrical connector as claimed in claim 1, wherein each mating portion comprises a curved portion connecting the upper and the lower enlarged portions.

6. The electrical connector as claimed in claim 5, wherein the upper and the lower enlarged portions of one mating portion are opposite to the upper and the lower enlarged portions of the other mating portion respectively.

7. The electrical connector as claimed in claim 6, wherein each enlarged portion has a chamfered face.

8. The electrical connector as claimed in claim 6, wherein widths of the upper enlarged portions are substantially equal to widths of the lower enlarged portions and are larger than widths of remaining portions of the arms, and wherein a space between the two lower enlarged portion is smaller than a space between the two arms.

9. The electrical connector as claimed in claim 1, wherein the body portion, the two arms and the two lower enlarged portions of the two mating portions are located in a first plane, and wherein the two upper enlarged portions of the two mating portions are located in a second plane which is substantially parallel to the first plane.

10. The electrical connector as claimed in claim 1, wherein each receptacle contact comprises a tail portion extending from the body portion.

11. A connector assembly comprising:

an insulative housing defining at least one row of passageways therein, a plurality of contacts side by side linked on a contact strip having a same pitch arrangement with that of said passageways, and simultaneously inserted, along a front-to-back direction, into the corresponding passageways, respectively, and later severed from said contact strip, each of said contacts including:

a body portion coplanar with said contact strip prior to severing therefrom, a bifurcated section formed in front of said body portion, and a pair of mating portions formed at a free end of said bifurcated section, each of said pair of mating portions including spaced upper and lower sections, and a curved portion intermediately connected between the upper and lower sections; wherein the upper and lower sections of both said pair of mating portions together define four contact points commonly engaging circumferentially a cylindrical pin which is inserted into the corresponding passageways along said front-to-back direction.

12. The assembly as claimed in claim 11, wherein both said upper and lower sections are substantially parallel to said body portion.

13. The assembly as claimed in claim 11, wherein each of said upper and lower sections are larger than each curved portion in a lateral direction perpendicular to said front-to-back direction.

14. The assembly as claimed in claim 11, wherein said curved portion is located at an outermost position of said contact along said front-to-back direction.

* * * * *